United States Patent [19]

Hönmann et al.

[11] 4,200,441

[45] Apr. 29, 1980

[54] REGENERATIVE HEAT EXCHANGER

[75] Inventors: Winfried Hönmann; Gerd E. Schaal, both of Stuttgart, Fed. Rep. of Germany

[73] Assignee: LTG Lufttechnische GmbH, Stuttgart, Fed. Rep. of Germany

[21] Appl. No.: 811,412

[22] Filed: Jun. 29, 1977

[30] Foreign Application Priority Data

Jun. 29, 1976 [DE] Fed. Rep. of Germany ..... 2629120
Feb. 14, 1977 [DE] Fed. Rep. of Germany ..... 2706139

[51] Int. Cl.[2] ..... B01D 53/26

[52] U.S. Cl. ..... 55/181; 55/390; 165/10

[58] Field of Search ..... 55/78, 181, 208, 388, 55/390; 165/10

[56] References Cited

U.S. PATENT DOCUMENTS

| | | | |
|---|---|---|---|
| 2,038,071 | 4/1936 | Wilhelm | 55/388 X |
| 3,092,477 | 6/1963 | Persson | 55/390 X |
| 3,373,798 | 3/1968 | Brummett | 165/10 |
| 3,398,510 | 8/1968 | Pennington | 55/390 X |
| 3,733,791 | 5/1973 | Dravnieks | 55/390 |
| 3,800,859 | 4/1974 | Norback | 55/390 X |
| 3,844,737 | 10/1974 | Macriss et al. | 55/390 X |
| 3,910,344 | 10/1975 | Hagen | 165/10 |
| 3,965,695 | 6/1976 | Rush et al. | 55/390 X |
| 3,982,981 | 9/1976 | Takao et al. | 165/10 X |
| 4,084,633 | 4/1978 | Strindehag | 165/10 X |

FOREIGN PATENT DOCUMENTS

| | | | |
|---|---|---|---|
| 1451156 | 2/1969 | Fed. Rep. of Germany | 165/10 |
| 218122 | 8/1968 | U.S.S.R. | 165/10 |

*Primary Examiner*—Robert H. Spitzer
*Attorney, Agent, or Firm*—Edwin E. Greigg

[57] ABSTRACT

A heat exchanger of the regenerative type comprising a rotor constructed of corrugated strip layers providing transverse channels extending therethrough. The device is arranged to have separate gas streams directed through different parts of the rotor so that on rotation of the rotor the storage mass effects the exchange of sensible heat between the streams.

21 Claims, 7 Drawing Figures

FIG. 1
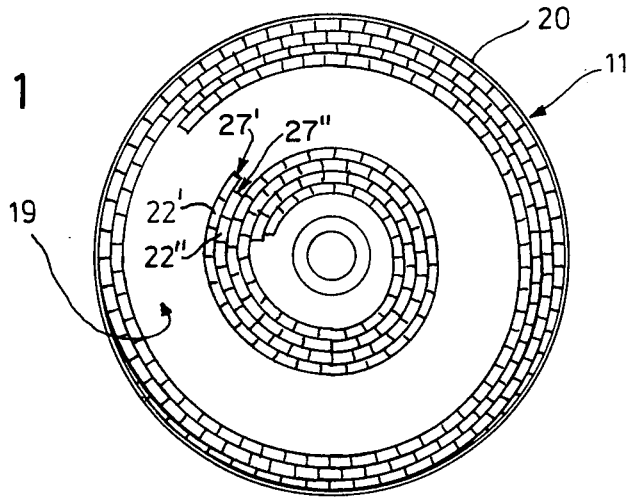
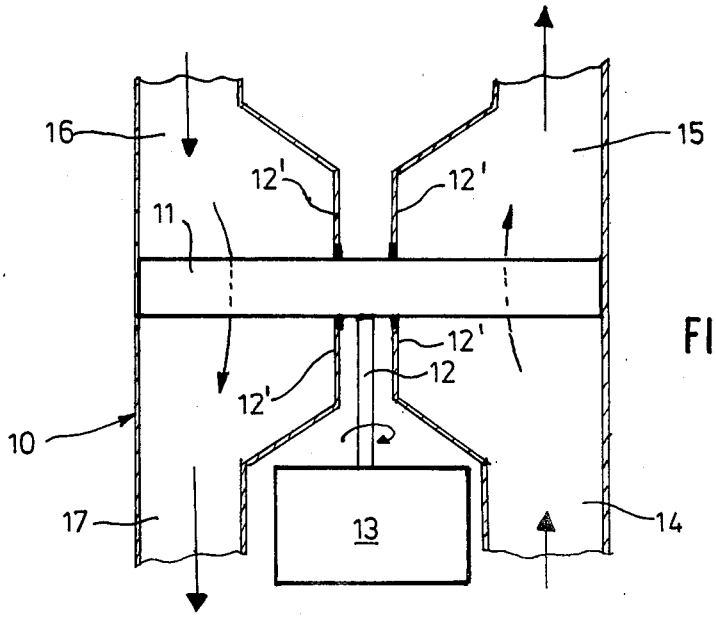
FIG. 2

FIG. 3
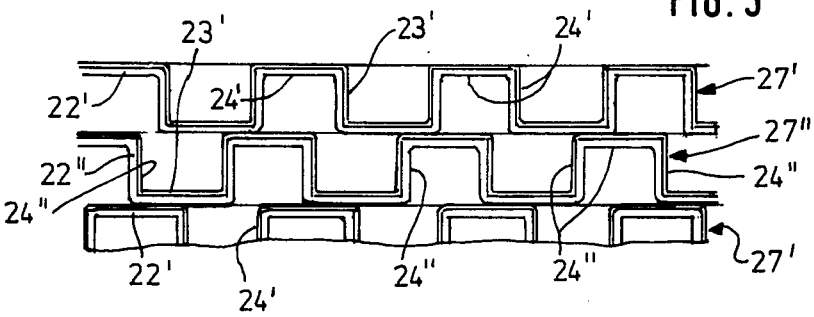
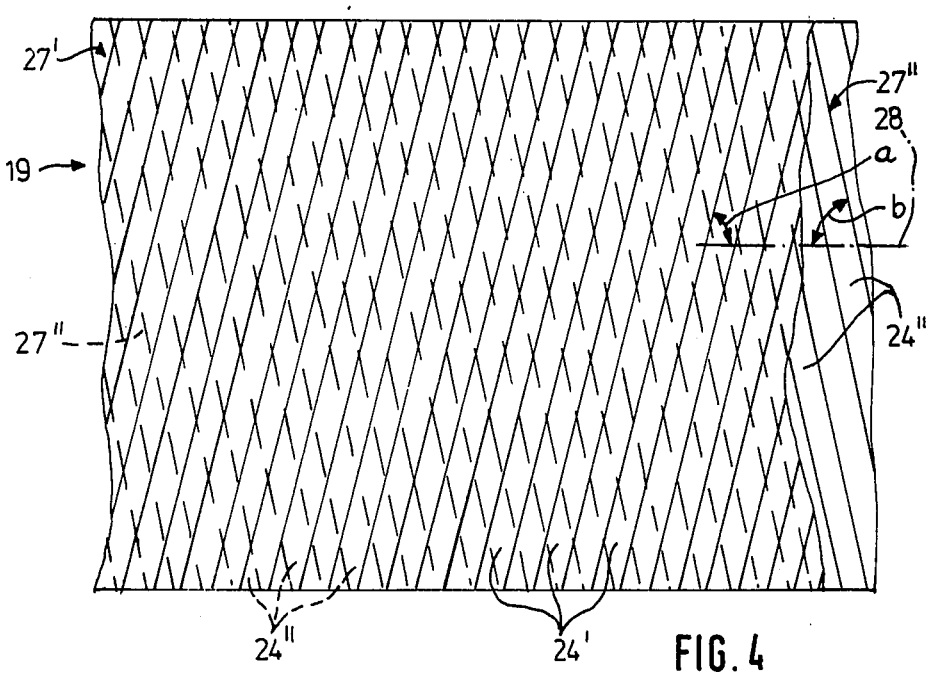
FIG. 4

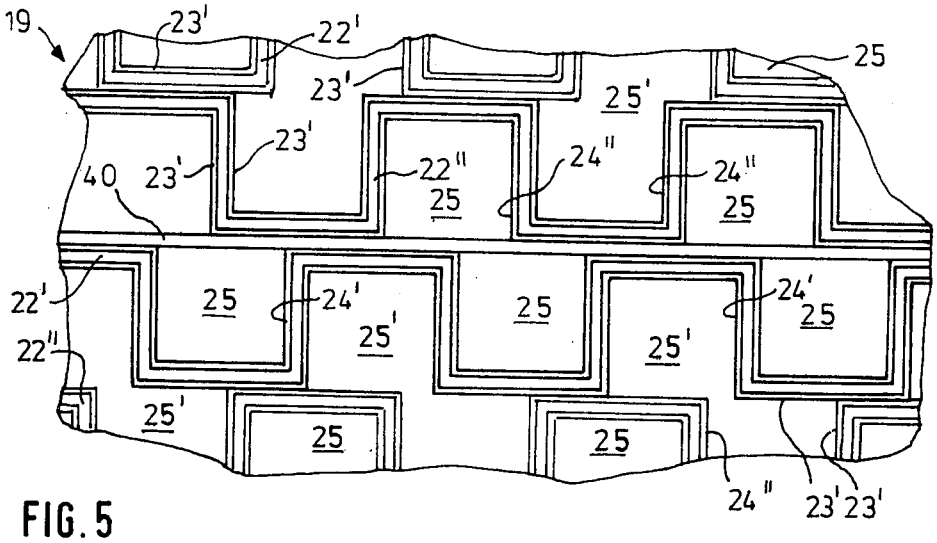
FIG. 5
FIG. 6
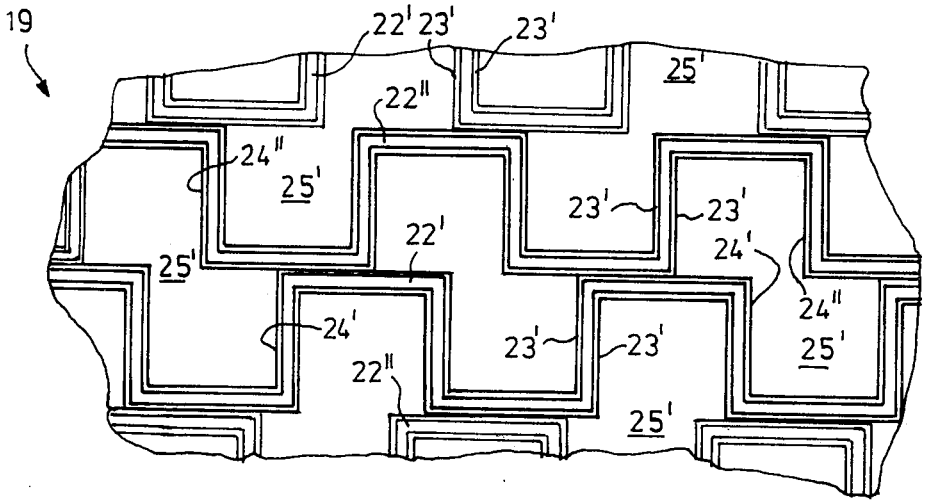
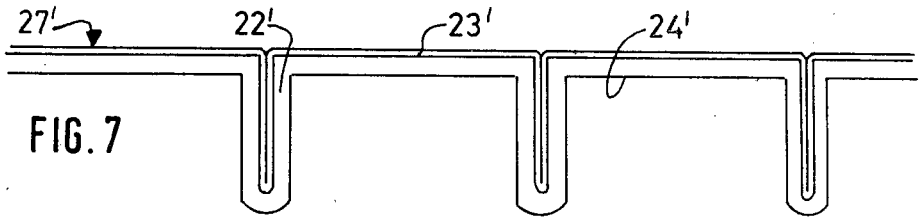
FIG. 7

REGENERATIVE HEAT EXCHANGER

SUMMARY OF THE INVENTION

This invention relates to a regenerative heat exchanger.

According to the present invention, there is provided a regenerative heat exchanger comprising a rotor having a heat storage mass consisting at least substantially of corrugated strip layers with transverse channels extending from one end to the other, and means for simultaneously directing separate gas streams through different parts of the rotor, whereby on rotation of the rotor the storage mass effects the exchange of sensible heat and/or moisture heat between the streams, the heat storage mass being formed by adjacent corrugated strip layers with transverse channels, the transverse channels of alternate corrugated strip layers being inclined relative to the transverse channels of the corrugated strip layers lying therebetween, and at least some of the transverse channels being open towards the transverse channels of adjacent layers.

By the method acording to the invention, the efficiency of the regenerative heat exchanger is considerably improved as compared with known heat exchangers where the transverse channels are disposed parallel to the axis of the rotor. The heat exchanger may thus be more cheaply constructed for a given heat exchange capacity or the heat exchange capacity increased.

The heat exchanger serves for the recovery of sensible heat and preferably also moisture heat, in particular enthalpy exchange, in that the heat exchanger removes the sensible heat, with corresponding temperature reduction, and moisture, with corresponding moisture loss, from one gas stream and transfers them to the other gas stream. In this manner considerable savings in energy are obtained in the operation of an air conditioning installation or the like, so that the cost of heating during winter operation and of cooling during summer operation are considerably reduced. The heat exchanger according to the invention gives particularly high heat exchange efficiencies.

The sensible heat is to be considered as the heat manifested by the temperature of the gas concerned, and the moisture heat is to be considered as the heat present in the moisture whilch is transferred by the heat exchanger by condensation or absorption of the moisture from one gas stream and subsequent evaporation or giving up of the moisture into the other gas stream.

The storage mass may for example consist exclusively of corrugated metal strips or exclusively of non-metal corrugated strips, or consist of corrugated strips of plastics or the like non-metallic material reinforced with metal or containing metal powder, and/or coated or impregnated with hygroscopic substances on a metal or other base layer, or at least partly covered with hydrophilic foil or the like.

By the measure according to the invention, the number of starting runs of the flow boundary layer in the rotor is considerably increased, so considerably increasing the heat exchange.

Preferably, the transverse channels of neighbouring corrugated strip layers are inclined at an acute angle in opposite directions to the longitudinal direction of the corrugated strip in order to give a particularly large increase in heat exchange. However, in many cases the transverse channels of neighbouring corrugated strip layers may for example be inclined in the same direction to the longitudinal direction of the corrugated strip but at different acute angles. It is particularly advantageous if each transverse channel of a corrugated strip spans at least two and preferably at least five of the open transverse channels facing it in its neighbouring corrugated strip. The corrugated strips then lie against each other and may preferably be completely or partially covered with non-metallic thin hydrophilic foil.

It is particularly advantageous if the storage mass is formed by spirally winding together two or more superimposed corrugated strips. However, it is also possible to form the storage mass from corrugated strips which are not wound together spirally, e.g. to form the corrugated strips into segmented layers which are built up into the storage mass etc.

The corrugated strips may be of any suitable shape and size, and preferably their transverse channels are of approximately rectangular cross-section so as to be in the shape of a square wave. However, other forms of cross-section are acceptable for the corrugated strips, for example sine waves.

In order to provide satisfactory heat transfer properties for sensible heat and also for moisture heat without coating the corrugated strips with hygroscopic substances, which make the cleaning of the rotor difficult, a corrugated strip at least partly covered with a non-metallic hydrophilic foil may be used. In this case, by suitably choosing the material for the supporting corrugated strip and the differing material for the thin foil, the heat exchange properties relative to the exchange of sensible heat and to the exchange of moisture heat may be made to satisfy a determined relationship, so that there is considerable freedom of construction relative to the ratio of free total surface and mass of the foil or foils to the total surface and mass of the supporting corrugated strip or strips. The foil also evidently contributes to the heat exchange of the sensible heat, and thus it is desirable to form the rotor such that the influence of the foil on the sensible heat exchange is only small.

In practice, particularly with ventilating and air conditioning systems, the gas stream of lower temperature may sometimes reach temperatures which are considerably lower than 0° C., for example where this gas stream is external air. Where this gas stream is at very low temperatures of e.g. −10° C. and below, permanent rime can form in the transverse channels, with rime increasingly forming in particular in the region of the upstream openings of the transverse channels, in relation to the gas stream of higher temperature, with the corresponding cross-sections becoming so heavily obstructed that the gas streams flowing through the rotor are too strongly throttled.

This problem may also be improved in relation to the prior art by at least partially covering the corrugated strip with hydrophilic non-metallic foil so that more than half of the circumferences of the ducts formed by the transverse channels are covered with foil. This form of the heat exchanger storage mass allows at least a sufficient gas throughput to maintain emergency operation at temperatures in the low temperature gas stream of under −10° C., as the proportion of free surface formed by hydrophilic foil may be made greater relative to the free metal surface the lower the temperature of the low temperature gas stream. Universal use of the heat exchanger with only minimum or no rime formation in the channels concerned is possible to extremely low temperatures by completely covering the surfaces of the channels with foil. If in this case the heat transfer properties of the heat exchanger are required to be as large as possible for the sensible heat, then this can be attained by using very thin hydrophilic foil.

For emergency operation the following is understood: ventilation and air conditioning installations are over-dimensioned in relation to the minimum external air quantities required for ventilation or air conditioning, for example by 50%. For emergency operation it is particularly to be understood that the said minimum external air quantities are more or less available at the foreseen lowest temperature of the gas stream or streams.

Preferably cellophane foil may be used as the hydrophilic foil. Cellophane foil has very good hydrophilic properties and is easily cleaned by wetting with water or dirt-dissolving cleaning fluid. However in many cases other materials may be desirably used for the foil, preferably cellulose acetate or thermoplastic polymers which are either hydrophilic or hydrophile-treated, such as polyamides, polyvinylchloride or the like, which are also easily cleaned.

Advantageously the foil may have a thickness of about 0.02–0.1 mm.

The coated or uncoated corrugated strip is preferably of metal. It is conveniently formed from a metal strip by bending the strip. In many cases metal gauze or the like may be used. Particularly good heat conducting metals such as aluminium or copper are desirble. If high corrosion resistance is required, a suitable non-corrosive metal may be used for the corrugated strip, preferably stainless steel. The thickness of the strip or gauze used for the corrugated strip is preferably 0.1–0.3 mm and in particular approximately 0.2 mm, but other thicknesses may be used. Such corrugated metal strips produce a particularly high heat exchange efficiency for the sensible heat.

The axial length of the rotor may be kept short, e.g. 10–35 cm in view of the good heat transfer properties, giving low pressure drop and particularly economical operation.

The length of corrugations of all corrugated strips may be the same, and in most cases this is particularly desirable. However where appropriate, different or varying corrugation lengths for the corrugated strips in the heat storage mass may be used.

The invention will now be more particularly described by way of example only with reference to the accompanying drawings, in which:

BRIEF DESCRIPTION OF THE DRAWINGS

FIG. 1 is an end view of the rotor of one embodiment of the invention;

FIG. 2 is a plan view of a heat exchanger equipped with the rotor shown in FIG. 1, the heat exchanger housing being shown in longitudinal section;

FIG. 3 is a partial end view of a heat storage mass for a rotor composed of two spirally wound corrugated strips each covered on one side with foil;

FIG. 4 is a partial plan view of an upper and a lower layer of the heat storage mass of FIG. 3;

FIGS. 5 and 6 are respective partial end views of a storge mass in accordance with two further embodiments;

FIG. 7 is a partial end view of a corrugated strip with transverse channels on only one side.

DESCRIPTION OF THE PREFERRED EMBODIMENTS

The regenerative heat exchanger shown in FIG. 2 comprises a housing 10 in the interior of which a rotor 11 of the type shown in FIG. 1 is disposed on a shaft 12 driven by a geared motor 13 of variable speed. When in operation, the rotor 11 is simultaneously traversed by two air streams flowing in opposite directions, wherein in this preferred embodiment it is assumed that one of the air streams is external air and the other air stream is exhaust air from an air conditioning installation in a building. The external air flows through an inlet nozzle 14 and, after traversing the rotor 11, through an outlet nozzle 15 and into a further duct, not shown. The exhaust air flows through an inlet nozzle 16, through the rotor 11, and out through an outlet nozzle 17. The flow paths for the exhaust air and external air are separated from each other by intermediate walls 12' and gaskets resting on the rotor 11. Fans provided for creating the air streams are not shown.

As shown in FIG 1, a heat storage mass 19 of the rotor 11 is fixed in a drum 20 carrying the shaft 12, the cylindrical circumferential wall of the drum being a close fit inside the housing 10. Two corrugated strips 27', 27'' from which the heat storage mass 19 is formed by spiral winding, are shown exaggeratedly large in FIG. 1.

As shown in FIGS. 1, 3 and 4 the heat storage mass 19 of the rotor 11 is formed by winding together two superimposed double-layer corrugated strips 27', 27'' of the same width about the axis of rotation of the rotor. Each corrugated strip 27', 27'' is formed from a double-layer strip by bending it into approximately rectangular corrugations of the same cross-sectional shape. One layer of each strip 27', 27'' consists of a corrugated metal strip 22' and 22'', and the other layer consists of a thin non-metallic foil 23' covering the corrugated strip 22', 22'' and is preferably formed of cellophane. FIG. 4 is a partial plan view of the two upper layers of a storage mass formed from these two corrugated strips 27', 27'', and it can be seen that in the case of the upper corrugated strip 27', its straight transverse channels 24' are inclined to the longitudinal direction 28 of the strip 27' by an acute angle a, whereas the straight transverse channels 24'' of the corrugated strip 27'' lying thereunder are inclined by an angle b to the longitudinal direction 28 of the strip 27'' in the opposite direction to the inclination of the transverse channels 24' of the upper strip 27', so that each transverse channel 24' of the strip 27' openly crosses and embraces several of the channels 24'' of the other strip 27'' which open towards it, at a contained angle of $180°-(a+b)$. Preferably the angle a and b are of the same size. The contained angle may advantageously be in the range 4° to 20°, and preferably 10° to 15°. In the illustrated embodiment, each transverse channel crosses approximately four or five transverse channels which open towards it, and approximately four or five internal transverse bottom portions of the neighbouring corrugated strip. In many cases it is also advantageous to allow one of the two corrugated strips 27' or 27'' to extend perpendicular to the longitudinal direction of the strip, or to incline the transverse channels of both strips 27', 27'' in the same direction but at different angles to the longitudinal direction of the strips.

The relative inclination of the transverse channels 24', 24'' has the advantage that the corrugations of the superimposed layers of strip cannot penetrate into each other. More importantly however, the rate of heat exchange is considerably increased as the mutually facing transverse channels of the neighbouring strips 27', 27" are open towards each other, as shown. The foils 23' follow the corrugations of the corrugated strips 22', 22", lying tightly against them. It is not only at the beginning of each transverse channel of the storage mass that there is a starting run for the flow boundary layer for the inflowing gas, but instead as it flows through the rotor there are continuously new starting runs at different distances from the inlets. As the heat exchange is greatest at the starting runs in the flow boundary layer, this supplementary formation of such starting runs considerably increases the heat exchange both for the sensible and moisture heat, and thus considerably raises the heat exchange efficiency of the heat exchanger.

In this embodiment, the free surfaces of the storage mass washed by the gas streams are half formed by foils 23' and half by metal strips 22', 22". The metal strips 22', 22" are preferably of a particularly good heat conducting metal such as copper, aluminium or stainless steel, so as to achieve a good heat exchange of sensible heat. The foil 23' is preferably very thin so as not to influence substantially the exchange of sensible heat, being of considerably lower mass than the corrugated strip 22', 22", and having poor heat conductivity. However, on account of its hydrophilic properties, the foil 23' decisively influences the moisture exchange.

The corrugated strips 27', 27" may alternatively consist of any other suitable material such as cardboard, asbestos, plastics or the like. They may be uncoated, or coated on one or both sides with a hygroscopic substance, e.g. lithium chloride or the like, to increase the moisture heat exchange. Such hygroscopic substances may for example be used in place of the foil 23'.

In the embodiments shown in FIGS. 5 and 6, the heat storage mass is formed from two respective corrugated strips 22',22" wound in the form of parallel spirals such that the longitudinal direction of the transverse channels 24' of one of the corrugated strips 22' is again inclined to the longitudinal direction of the transverse channels 24" of the other corrugated strip 22", and preferably inclined at acute angles in opposite directions to the longitudinal corrugated strip direction, so that each transverse channel 24', 24" of one corrugated strip desirably crosses at least one, preferably at least two, and particularly advantageous three to six or more of the transverse channels of the adjacent corrugated strip which faces it.

In the case of FIG. 5, the heat storage mass is formed from two corrugated strips 22', 22" with approximately rectangular corrugations covered on both sides with hydrophilic non-metallic foil 23', which strips are superimposed with the interposition of a non-corrugated intermediate strip 40 of metal or hydrophilic foil or a metal strip covered on one or both sides with a hydrophilic non-metallic foil, these three mutually parallel strips then being wound together to form the storage mass. Between every second pair of corrugated strip coils in the storage mass there is then disposed an intermediate strip 40 which spans its neighbouring transverse channels 24', 24" (corrugated strip layers), so that one half of the transverse channels 24', 24" form ducts 25 of constant cross-section with the intermediate strip 40, whereas the other opposing transverse channels 24', 24" of these two corrugated strips are open towards each other and thus form ducts 25' of varying cross-section. In this latter case there is no intermediate band 40 between the two corrugated strips 22', 23'; 22", 23", so that by crossing these mutually open transverse channels 24', 24", additional starting runs are formed for the gas flow boundary layer in a simple manner which favours the flow, and the heat transfer is considerably increased.

Instead of covering each corrugated strip 22', 22" on both sides with hydrophilic foils 23' which follow the corrugations and extend over the length and breadth of the corrugated strip as in the embodiment shown in FIG. 5, in many cases it may be desirable to leave at least one corrugated strip uncovered or covered only on one side, and preferably to dispense with the foil covering on those sides of the corrugated strips 22', 22" which bound the ducts 25, so that the total free inner surfaces of the ducts 25' are formed completely from hydrophilic foils 23', as is often particularly desirable. If the intermediate strip 40 is likewise of hydrophilic foil, then this is also true for the ducts 25 formed by the intermediate band 40 where both corrugated strips 22', 22", as shown, are covered on both sides with foil 23'. If however the intermediate strip 40 is of metal, obviously nothing changes with regard to the free inner surfaces of the ducts 25' which are completely of hydrophilic foil, but in this case one of the walls of each of the ducts 25 formed by the intermediate strip is then of metal.

The embodiment shown in FIG. 6 differs from that shown in FIG. 5 in that there is no intermediate strip, so that each transverse channel 24', 24" of each corrugated strip 22', 22" covered on both sides with hydrophilic non-metallic foil 23' is open towards its open opposing transverse channel 24", 24' of the neighbouring corrugated strip, and it is then particularly desirable for the transverse channels 24', 24" of both transverse strips to be inclined in opposite directions to the end planes of the storage mass, for example as shown in FIG. 3. Although both corrugated strips 22', 22" are covered on both sides with hydrophilic foil 23', the heat transfer relative to sensible heat is still very high because of the multiplication of starting runs for the gas stream boundary layer. Because of the foils 23', the transfer of moisture heat is considerably better than in the case of free metal transvere channel surfaces and there is also no danger of icing up. The storage mass shown in FIG. 6 gives optimum protection against rime formation and its resistance to flow is unchanged down to very low temperatures of the low-temperature gas stream so that it may be used universally and in particular down to extremely low temperatures.

Instead of directing the transverse channels of the corrugated strip alternately towards one side and the other of the corrugated strip, as in the case of the previous embodiments, in many cases, as shown in FIG. 7, at least one corrugated strip 27' may be corrugated in such a manner that its transverse channels 24' are present all on the same side. These transverse channels likewise cross the transverse channels of the unillustrated neighbouring corrugated strip layer which are open towards it. The illustrated corrugated strip consists of a support layer 22' of metal or the like, and a hydrophilic foil layer 23'.

The storage mass, or segments of the storage mass, may be produced in other ways to that described, for example by arranging corrugated strip layers in stacks.

What is claimed is:

1. A regenerative heat exchanger comprising a rotor having a heat storage mass consisting at least substantially of two superimposed corrugated strip layers each having a plurality of longitudinally spaced transverse channels open alternatingly in opposite directions and having a maximum length extending between the side edges of said strip layers, said two corrugated strip layers being wound convolutely about the axis of rotation of said rotor in a plurality of plies and means for simultaneously directing separate gas streams through different parts of the rotor, whereby on rotation of the rotor the storage mass effects the exchange of sensible heat and/or moisture heat between the streams, the heat storage mass being formed by adjacent corrugated strip layers provided with transverse channels having a longitudinal direction, said transverse channels of said two corrugated strip layers being inclined in opposite directions to the longitudinal direction of said corrugated strip layers with the open transverse channels of maximum length of one of said corrugated strip layers arranged to span between two to six transverse channels of the other corrugated strip layer which are open towards it.

2. A heat exchanger as claimed in claim 1, wherein all mutually facing transverse channels are open towards each other.

3. A heat exchanger as claimed in claim 1, wherein each open transverse channel of a corrugated strip layer spans four to five transverse channels of the adjacent corrugated strip layer which are open towards it.

4. A heat exchanger as claimed in claim 1, wherein the transverse channels of the corrugated strip layers are open alternately towards one and the other side of the corrugated strip.

5. A heat exchanger as claimed in claim 1, wherein the transverse channels of adjacent corrugated strip layers cross each other at a contained angle of approximately 5°-20°.

6. A heat exchanger as claimed in claim 5, wherein said contained angle is preferably 10°-15°.

7. A heat exchanger as claimed in claim 1, wherein at least one corrugated strip is at least partly covered with a non-metallic hydrophilic foil serving for moisture exchange, said corrugated strip consisting of another material which governs the exchange of sensible heat.

8. A heat exchanger as claimed in claim 7, wherein the foil is cellophane foil.

9. A heat exchanger as claimed in claim 7, wherein the foil is of thermoplastic polymerised plastics.

10. A heat exchanger as claimed in claim 7, wherein the foil is of cellulose acetate.

11. A heat exchanger as claimed in claim 7, wherein the foil thickness is 0.02 to 0.1 mm.

12. A heat exchanger as claimed in claim 7, wherein each corrugated strip layer is formed from a metal strip.

13. A heat exchanger as claimed in claim 12, wherein the metal is aluminium, copper or stainless steel.

14. A heat exchanger as claimed in claim 7, wherein the free inner surfaces of at least half the number of ducts formed by the transverse channels consist over more than half their respective circumference of hydrophilic foil.

15. A heat exchanger as claimed in claim 14, wherein the total free inner surfaces of all transverse channels are formed from hydrophilic foil.

16. A heat exchanger as claimed in claim 1, wherein the corrugated strip comprises a metallic web and a foil arranged to cover said metallic web.

17. A heat exchanger as claimed in claim 1, wherein the transverse channels of the corrugated strip are of substantially rectangular cross-section.

18. A heat exchanger in accordance with claim 1 wherein the transverse channels on one of the sides of each corrugated strip layer of the storage mass are open towards the neighbouring corrugated strip layer to form, with the open transverse channels of this latter which face them, ducts which are commonly bounded thereby, whereas the transverse channels on the other sides of these corrugated strip layers are spanned by at least one non-corrugated unperforated intermediate strip to separate these transverse channels into one duct per transverse channel.

19. A heat exchanger as claimed in claim 18, wherein the intermediate strip comprises hydrophilic foil.

20. A heat exchanger as claimed in claim 19, wherein the intermediate strip consists of a metal strip covered on one side with hydrophilic foil.

21. A heat exchanger as claimed in claim 19, wherein the intermediate strip is a metal strip covered on both sides with hydrophilic foil.

* * * * *